United States Patent [19]
Huther

[11] Patent Number: 4,471,008
[45] Date of Patent: Sep. 11, 1984

[54] METAL INTERMEDIATE LAYER AND METHOD OF MAKING IT

[75] Inventor: Werner Huther, Karlsfeld, Fed. Rep. of Germany

[73] Assignee: MTU Motoren-Und-Turbinen Union Munchen GmbH, Munich, Fed. Rep. of Germany

[21] Appl. No.: 404,013

[22] Filed: Aug. 2, 1982

[30] Foreign Application Priority Data

Aug. 21, 1981 [DE] Fed. Rep. of Germany ..... 3133158

[51] Int. Cl.³ ..... F01D 5/30; B05D 1/12; B05D 5/00

[52] U.S. Cl. ..... 427/383.5; 416/241 B; 427/383.3

[58] Field of Search ..... 428/546, 553, 558, 559, 428/560, 472; 29/DIG. 4, 530; 427/191, 192, 376.6, 376.7, 376.8, 180, 383.3, 383.5; 416/221, 219 R, 241 B; 228/248

[56] References Cited

U.S. PATENT DOCUMENTS

| | | | |
|---|---|---|---|
| 2,139,431 | 12/1938 | Vatter | 427/191 |
| 2,722,496 | 11/1955 | Hosmer | 427/383.5 |
| 2,908,072 | 10/1959 | Johnson | 427/376.6 |
| 2,922,721 | 1/1960 | Tarkan et al. | 427/180 |
| 2,976,401 | 8/1961 | Welch et al. | 427/191 |
| 3,068,556 | 12/1962 | Kramer | 29/156.8 B |
| 3,088,192 | 5/1963 | Turner | 428/937 |
| 3,150,938 | 9/1964 | Pelton et al. | 427/180 |
| 3,317,988 | 5/1967 | Endres | 416/221 |
| 3,442,010 | 5/1969 | Albers | 228/248 |
| 3,692,501 | 9/1972 | Hoppin et al. | 428/678 |
| 3,700,427 | 10/1972 | Hoppin et al. | 416/241 B |
| 3,716,347 | 2/1973 | Bergstrom et al. | 228/248 |
| 3,722,071 | 3/1973 | Van Orsdel | 427/376.8 B |
| 3,910,719 | 10/1975 | Hessler et al. | 416/219 R |
| 3,975,165 | 8/1976 | Elbert et al. | 427/191 |
| 4,051,585 | 10/1977 | Walker et al. | 416/241 B |
| 4,096,615 | 6/1978 | Cross | 416/241 B |
| 4,101,691 | 7/1978 | Borchert | 427/191 |
| 4,175,912 | 11/1979 | Crane et al. | 416/500 |
| 4,207,029 | 6/1980 | Ivanko | 416/241 B |
| 4,335,998 | 6/1982 | Siebels | 416/241 B |

FOREIGN PATENT DOCUMENTS

| | | | |
|---|---|---|---|
| 4736 | 1/1978 | Japan | 427/191 |
| 1079734 | 8/1967 | United Kingdom | 427/191 |

OTHER PUBLICATIONS

"Metal-Ceramic Brazed Seals", Bondley, R. J., *Electronics*, Jul. 1947, pp. 97–99.

"Brazing with Foil . . ." *Assembly Engineering*, Mar. 1980.

*Primary Examiner*—L. Dewayne Rutledge
*Assistant Examiner*—John J. Zimmerman
*Attorney, Agent, or Firm*—Alan H. Levine

[57] ABSTRACT

A metal intermediate layer between two generally parallel thrust surfaces. At least one of the thrust surfaces is ceramic, and the surfaces are oblique to the direction of force tending to press the surfaces toward each other. The intermediate layer is formed by applying a metal powder suspension to at least one of the surfaces, and thereafter drying and if necessary heating the suspension to remove the non-metallic portion of the suspension. The surfaces may be faces of the blade root and slot, which accommodates the root, of a turbomachine.

9 Claims, 2 Drawing Figures

METAL INTERMEDIATE LAYER AND METHOD OF MAKING IT

Figure 1:
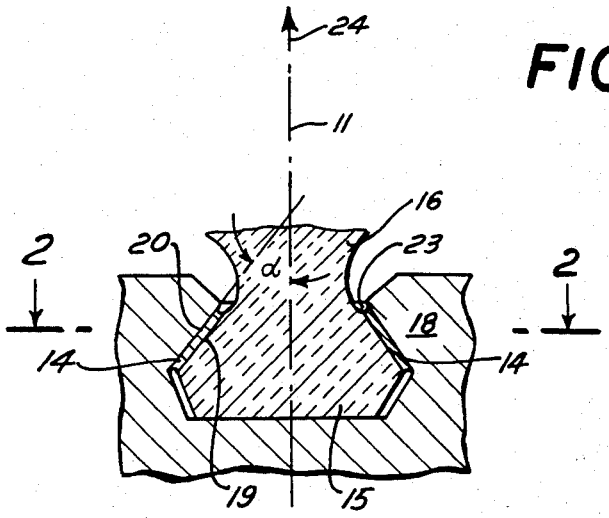

This invention relates to a metal intermediate layer between two thrust surfaces which are oblique to the direction of force tending to press the thrust surface together. More particularly, the invention relates to such a combination wherein one of the thrust surfaces is ceramic.

The invention will be described in relation to a turbomachine, e.g., a gas turbine engine, and especially with reference to mounting of a blade root within a slot formed in the rotor of such a machine. However, the invention has broader application.

When fluid temperatures in the bladed flow duct are high, the use of a ceramic material for the rotor blades, inclusive of their roots, and for the rotor disc, is often desirable. However, a major problem area is the connection of the ceramic blade, or its ceramic root, to the rotor disc, i.e., the blade root fixing.

The types of such slots are known, i.e., the slot generally extends, if it is a single slot for a single blade, in a direction parallel to the centerline of the rotor, or at an angle known from helical spur gears. If it is an annular slot for all the blades or roots of the disc and blade assembly, it extends in coaxial disposition with the rotor axis. Because it is made of ceramic material, the root when seen in a sectional view at right angles to the longitudinal direction of the slot, or to the direction in which the root is engaged in the slot, normally has a dovetail or fir tree shape. As a result, the generally plane abutment, or thrust, faces of the root and of the slot, which in the sectional view takes the same form as the root and into which the root is inserted, extend at an acute angle to the central plane of the root which extends in that direction of a radial rotor line. This angle of pressure generally is 30° to 75°, imposing an obliquely directed pressure on the thrust faces when the centrifugal forces come to bear on the blade.

In the root area, the maximum mechanical loads imposed on the rotor blade in service is caused by the compressive force that acts on the thrust faces as a result of centrifugal blade forces, consequently, the capacity of even high-strength ceramic materials, such as hot-pressed silicon nitride ($Si_3N_4$), is pushed to the limit if not in some cases exceeded.

A major problem in this connection is that the brittle, plastically nondeformable ceramic blade, or rather its root or thrust faces, does not uniformly abut on the thrust faces of the slot over the length of the slot, a phenomenon caused by inevitable dimensional deviations originating in manufacture. They often cause stress concentrations and so reduce the safe operating speed or allowable centrifugal load on the blade.

This disadvantage is alleviated or eliminated if a metal sheet or foil is inserted between the abutment faces. This sheet is capable of plastic deformation and so at least largely compensates for dimensional deficiencies suffered in manufacture. The sheet also makes for at least fairly uniform transfer of the forces involved to give the blade a higher safe speed, or similar properties, and a longer life.

The metal sheet additionally reduces friction between the blade root and the slot, thereby reducing the risk of the blade or its root seizing in the slot, as a result of temperature alternations, to add to its stresses. The following explanation is offered in this context: in operation, the rotor disc grows hot so that the slot widens and the blade moves outwards radially; then when the disc cools down and the blade is prevented by friction, in the absence of the sheet, to return to its original position, the slot again narrows and imposes additional stresses on the blade or its root.

Disadvantages encumbering use of the metal sheet are as follows: although its plastic deformability allows the sheet to adapt to changes, the stress peaks caused by manufacturing deficiencies in the ceramic root or additionally in the ceramic rotor disc are relieved only to some extent. Another consideration is that assembly of the blade, or its root, and the sheet is difficult when these parts are small. Another risk involves that of the sheet slipping before or while the turbomachine is being operated.

In a broad aspect, the present invention alleviates or eliminates the disadvantages cited above. It is a particular object of the present invention to provide an intermediate layer by applying a metal powder coating to at least one of the thrust surfaces. The coating of the present invention more fully relieves said stress peaks because the coating or coatings are more readily deformed under the compressive forces from the thrust faces than is the sheet. Also, the coating or the coatings are easy to produce, and the coating adheres firmly to the thrust face or the two thrust faces. The place of the sheet is taken by the coating or coatings, so that the trouble previously encountered in the assembly of small blades or blade roots is eliminated. The threat of slipping, as in the case of the sheet, is also eliminated.

In order to produce the coating in accordance with the present invention, a powdered metal suspension is applied to the thrust face or faces, where it will dry in place. Then when the dried suspension is heated, a solid content of the nonmetallic component of the suspension is allowed to escape, and the coating remains. It consists of the metal that went into the metal powder. The mean particle size of the metal powder more particularly is 0.1 μm to 50 μm.

The invention generally finds use when the thrust or joint face comes under thermal loads in addition to the thrust stresses. The invention can advantageously be applied also when the thrust area or joint is exposed to the pressure of a fluid; when the coating or coatings of the present invention are used, the thrust or joint area will exhibit improved sealing integrity.

The intermediate layer of the present invention finds use especially on the thrust faces of interlocking or similarly joined parent components, as for instance with blade root fixings, where the compressive load is produced by the pull exerted, with these blade root fixings, by centrifugal force.

For the metal powder, use may be made of powdered platinum, nickel, chromium, titanium, tantalum, copper, magnesium, or zinc, or blends of at least two of these metal powders. Which metal or metal blend to choose depends on the service temperature of the thrust or joint area to be coated. The nonmetallic components of the suspension may be an organic liquid, a lacquer, or a lacquer-like or similar liquid, preferably zapon or cellulose nitrate lacquer, or a resin dissolved in alcohol, such as rosin.

In a further aspect of the present invention the suspension is normally thin-bodied. The suspension is easy to apply. It may be applied using an artist's brush. It will dry in air like, e.g., a lacquer. The nonmetallic constituent of the suspension has no oxidizing effect on the metal powder when being heated. A reductive effect, as with rosin, is desirable.

The intermediate layer is produced by applying the metal powder suspension to one or both thrust faces after which the parts carrying those faces are assembled. If desired, application of the suspension can take place after the parts are assembled. If necessary, heating of the dried suspension may take place before or after assembly of the parts. Preferably, the suspension is applied, after the parts are assembled, to the edge of the space between the thrust surfaces, after which the suspension fills the space by capillary action. In this manner a coating adhering to a thrust face or the two thrust faces or two coatings adhering to the two thrust faces is achieved. The capillary force mentioned above causes the intervening space to be filled completely with the suspension. When proceeding in this way, manufacturing deviations will be largely compensated for even before the plastic deformability of the coating is exploited, and this efficiently relieves stress concentrations. For metals which oxidise in air, heating of the dried suspension takes place in a reduced gas atmosphere at a temperature between 60% and 95% of the melting temperature of the metal. The resulting coating will largely resist oxidation. Metals oxidizing in air are, e.g., nickel or titanium.

The accompanying drawing illustrates an embodiment of an axial-flow blade root fixed to the rotor disc of an axialflow gas turbine, according to the present ivention.

Figure 2:
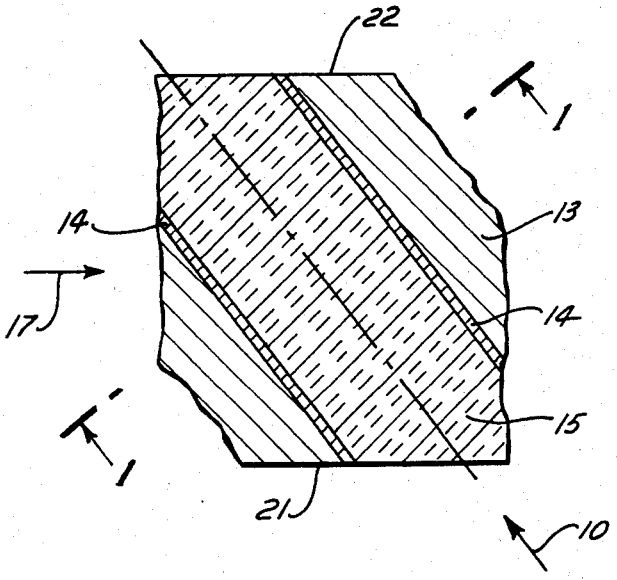

FIG. 1 is a cross-sectional view, taken along line 1—1 of FIG. 2, which is at right angles to the longitudinal direction of the slot, or to the direction in which the root is inserted into the slot; and FIG. 2 is a cross-sectional view, taken along line 2—2 of FIG. 1, which is at right angles to the central plane of the root extending along a radial line of the rotor.

The direction in which the blade root is inserted into its respective slot is indicated by the numeral 10, and the central plane of the root by the numeral 11. The direction 10 runs (see FIG. 2) at an angle to the circumferential direction (arrow 17) of the rotor disc 13. The axial-flow blade root attachment is formed essentially by the ceramic root 15 of the ceramic axial-flow rotor blade and the associated slot 17 of the metal rotor disc 13, plus the two metallic intermediate layers 14, which are here given exaggerated thickness for clarity of representation.

The blade root 15 continues in a necked portion 16, a part being broken away for clarity, and then in a blade pedestal and an airfoil, which are omitted in the drawing but all form part of the single-piece blade. The root 15 and the slot 18 have on either side of the centerline 11, and in mirror-image relation, two mutually conforming, parallel substrate faces 19 and 20 extending at an angle of about 40° with the centerline 11 (see FIG. 1) and sandwiching the intermediate layer 14 between them. Each of the two pairs of substrate faces 19 and 20 come under oblique compression, because of the angle of pressure as a result of radially acting centrifugal force (arrow 24).

The substrate faces 19 and 20 extend (see FIG. 2) from one face 21 to the other face 22 of the rotor disc 13. The intermediate layer 14 extends over the entire length of the substrate faces 19 and 20 (FIG. 2) and over the entire width of the substrate face 19 and over pratically the entire width of the substrate face 20 (FIG. 1). The substrate face 19 is somewhat narrower than the substrate face 20 and at full load of the axialflow gas turbine, as illustrated in FIG. 1, it is arranged at a short distance on either side from the longitudinal edges of the substrate face 20.

In order to produce the metallic intermediate layer 14, a metal powder suspension containing lacquer as a nonmetallic constituent, is applied with an artist's brush externally to the intermediate space between the substrates 19 and 20, on the longitudinal side 23 thereof, and capillary forces will then cause the intermediate space to be filled completely with the suspension. The suspension inside is then allowed to dry in the air, so that its solvent may evaporate. Thereafter the dried solution is heated by the fluid flowing through the bladed flow duct, causing the solid content of the lacquer to escape. The intermediate layer 14 firmly adheres to the substrate faces 19 and 20.

Although the invention has been described above for use with thrust surfaces oblique to the direction of a force tending to press the surfaces toward each other, it is generally useful where the thrust surfaces are transverse to the direction of that force, i.e., perpendicular or oblique to that force.

The invention has been shown and described in preferred form only, and by way of example, and many variations may be made in the invention which will still be comprised within its spirit. It is understood, therefore, that the invention is not limited to any specific form or embodiment except insofar as such limitations are included in the appended claims.

What is claimed is:

1. A method of producing an intermediate metal layer between two opposed thrust surfaces at least one of which is formed of a ceramic material, the surfaces being transverse to the direction of a force tending to press the surface toward each other, comprising the steps of:

applying a suspension of metal powder in a carrier to at least one of the thrust surfaces, thereafter drying the suspension, and thereafter heating the dried suspension at a temperature which is 60% to 95% of the melting temperature of the metal to remove the non-metallic content of the suspension and leave a metal coating which permits relative movement between the thrust surface and deforms when compressed between the thrust surfaces.

2. The method of claim 1 wherein the suspension is applied, dried, and fluted before the parts having the thrust surfaces are assembled together.

3. The method of claim 1 including the step of assembling the parts having the thrust surfaces, and thereafter applying the suspension to the edge of the space between the thrust surfaces so as to permit the suspension to be attracted between the thrust surfaces by capillary action.

4. The method of claim 1 wherein the drying is effected in an inert gas atmosphere to prevent oxidation of the metal.

5. The method of claim 1 wherein the heating is effected in an inert gas atmosphere to prevent oxidation of the metal.

6. The method of claim 1 wherein the carrier of the suspension is an organic liquid.

7. The method of claim 1 wherein the carrier of the suspension is a lacquer.

8. The method of claim 1 wherein the carrier of the suspension is selected from the group consisting of zapon, cellulose nitrate lacquer, and a resin dissolved in alcohol.

9. The method of claim 1 wherein one of the thrust surfaces is the face of a slot in the rotating member of turbo-machine, and the other surface is the face of a root of a blade arranged in the slot.

* * * * *